US005995773A

United States Patent [19]

Awano

[11] Patent Number: 5,995,773

[45] Date of Patent: Nov. 30, 1999

[54] POSTPROCESSING SYSTEM AND METHOD FOR USE WITH AN IMAGE FORMATION SYSTEM

[75] Inventor: Hiroaki Awano, Ebina, Japan

[73] Assignee: Fuji Xerox Co., Ltd., Tokyo, Japan

[21] Appl. No.: 09/109,419

[22] Filed: Jul. 2, 1998

[30] Foreign Application Priority Data

Jul. 10, 1997 [JP] Japan ..... 9-184883

[51] Int. Cl.[6] ..... G03G 15/00

[52] U.S. Cl. ..... 399/21; 399/124; 399/407

[58] Field of Search ..... 399/18, 20, 21, 399/124, 16, 107, 407; 271/279

[56] References Cited

U.S. PATENT DOCUMENTS

| | | | |
|---|---|---|---|
| 3,618,936 | 11/1971 | Ziehm | 399/21 X |
| 4,717,134 | 1/1988 | Iida et al. | 270/39.01 |
| 5,010,363 | 4/1991 | Higashio et al. | 399/19 |
| 5,083,760 | 1/1992 | Yamazaki et al. | 270/58.11 |
| 5,300,998 | 4/1994 | Ogisawa et al. | 399/124 |
| 5,746,162 | 5/1998 | Hosoi et al. | 399/407 X |
| 5,802,426 | 9/1998 | Miyazaki et al. | 399/124 X |

FOREIGN PATENT DOCUMENTS 9-295758 11/1997 Japan .

*Primary Examiner*—Robert Beatty
*Assistant Examiner*—Sophia S. Chen
*Attorney, Agent, or Firm*—Oliff & Berridge, PLC

[57] ABSTRACT

A postprocessing system having a system cabinet coupled to a copier main body through a coupling section, a postprocessing unit placed in the system cabinet so that it can be moved up and down, and a cover attached to the front of the system cabinet so that it can be opened and closed. When a paper jam occurs, the user can open the cover to open the inside of the system cabinet and remove jammed paper.

16 Claims, 15 Drawing Sheets

POSTPROCESSING SYSTEM AND METHOD FOR USE WITH AN IMAGE FORMATION SYSTEM

BACKGROUND OF THE INVENTION

This invention relates to a postprocessing system of an image formation system for performing predetermined postprocessing for paper on which an image is formed in an image formation system such as a copier or a printer.

Generally, an image formation system such as a printer and a postprocessing system such as a staple sorter have their respective cabinet structures separately, which usually are placed side by side and are coupled. In the actual processing operation, paper on which an image is formed in the image formation system is fed via the coupling part into the postprocessing system, which then performs predetermined postprocessing, such as stapling, for the paper as required, then discharges the paper to a tray.

By the way, if the image formation system and the postprocessing system are placed side by side and are coupled as described above and are operated, a paper jam easily occurs in the coupling part of both the systems where paper is passed. Particularly, not only a paper transport passage for passing paper from one system to the other, but also a paper transport passage required when a copy is made to both sides of paper, a paper transport passage for inverting the side of paper, and the like are often built in the coupling part of both the systems, thus a paper jam easily occurs in the coupling part.

However, in the related art, when a paper jam occurs in the coupling part of the image formation system and the postprocessing system, to remove paper, it is necessary to move the postprocessing system and detach the postprocessing system from the image formation system, thereby opening the paper transport passage in the coupling section. Thus, to install the system, it is necessary to reserve an extra space to allow the postprocessing system to be moved to remove the paper causing a paper jam, which will be hereinafter referred to as jammed paper.

SUMMARY OF THE INVENTION

A postprocessing system of an image formation system according to the invention comprises a system cabinet coupled to an image formation system main body, a postprocessing unit placed in the system cabinet, and a cover being attached at least to the front of the system cabinet so that it can be opened and closed for opening the inside of the system cabinet with the cover open.

In the configuration, if a paper jam occurs in the coupling section to the image formation system main body, the user can open the cover attached to the system cabinet for opening the inside thereof and remove jammed paper without moving the postprocessing system.

DETAILED DESCRIPTION OF THE PREFERRED EMBODIMENTS

Referring now to the accompanying drawings, there are shown preferred embodiments of the invention.

Figure 1A:
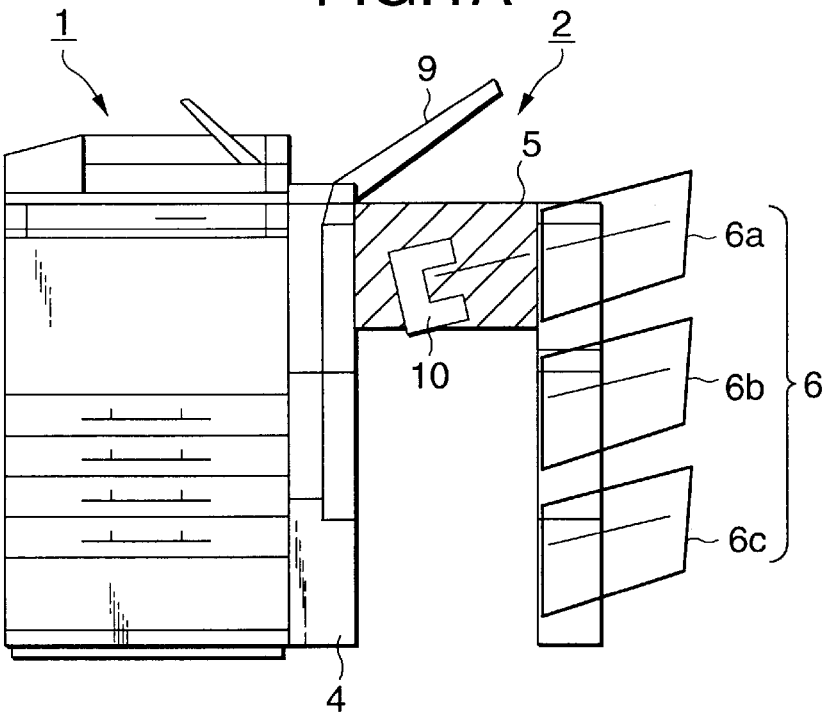
FIGS. 1A and 1B are drawing to describe one embodiment of a postprocessing system of an image formation system according to the invention.
Figure 1B:
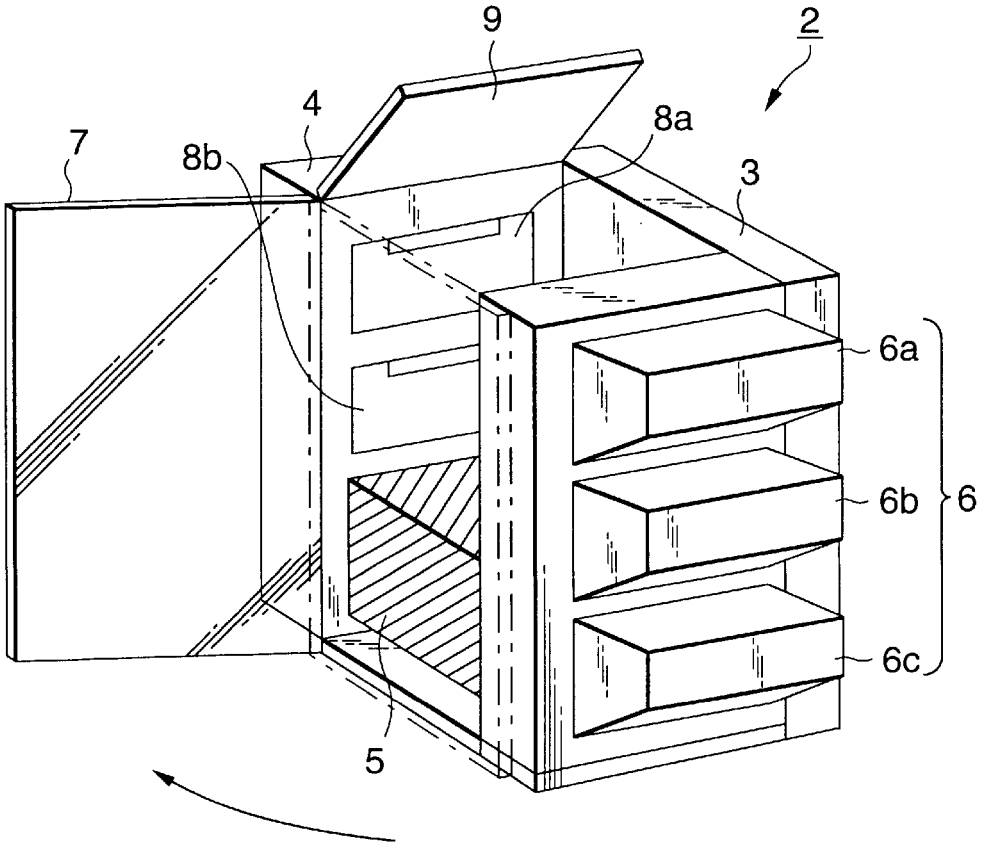

FIG. 1 is a drawing to describe one embodiment of a postprocessing system of an image formation system according to the invention; FIG. 1A is a schematic side view of the postprocessing system, and FIG. 1B is a perspective view thereof.

In FIG. 1, a postprocessing system 2 is connected to a paper discharge side of a copier main body 1 corresponding to an image formation system main body. The postprocessing system consists mainly of a system cabinet 3 opened on the top, a coupling section 4 for coupling the system cabinet 3 to the copier main body 1, a postprocessing unit 5 placed in the system cabinet 3, and a tray unit 6 for storing paper handled in the copier main body 1.

A cover 7 is attached to the front of the system cabinet 3 (where the user operating the system stands) with mounting hardware such as hinges, for example, so that it can be opened and closed. The front of the system cabinet to which the cover 7 is attached is opened largely from the top to the bottom and from side to side. The inside of the system cabinet 3 is opened with the cover 7 open as indicated by the arrow in the figure and is shielded by the cover 7 from the outside with the cover 7 closed as indicated by the phantom lines in the figure.

The coupling section 4 contains a paper transport mechanism (not shown) comprising paper transport passages defined corresponding various paper transport modes (described later) in addition to the coupling function to the copier main body 1. Paper chutes 8*a* and 8*b* for opening the paper transport passages defined in the coupling section 4 are attached to the side of the coupling section 4 facing the postprocessing unit 5 so that they can be opened and closed. Further, a purge tray (catch tray) 9 is disposed on the top of the coupling section 4.

The postprocessing unit 5 comprises a paper collation mechanism (not shown) for collating paper sent from the copier main body 1, a stapler 10 for binding the end of a paper bundle collated by the paper collation mechanism, and a paper discharge mechanism (not shown) for discharging the paper bundle bound by the stapler 10. The paper discharge mechanism has also a so-called offset function of discharging the paper bundles bound by the stapler 10 in offset relation in a predetermined amount.

The tray unit 6 is made up of three trays 6*a* to 6*c* placed on the paper discharge side of the system cabinet 3. The three trays 6*a*–6*c* are disposed at established intervals up and down. Applications are assigned to the trays in response to the processing mode in the copier main body 1, any desired postprocessing mode, etc. For example, if the copier main body 1 has a printer function and a facsimile function in addition to a normal copy function, a large-capacity tray application at the copying time is assigned to the upper tray 6*a*, a large-capacity tray application at the printer or facsimile processing time is assigned to the intermediate tray 6*b*, and any other processing (for example, internal binding) tray application is assigned to the lower tray 6*c*. The three trays 6*a*–6*c* are attached to the system cabinet 3 detachably, whereby they can be replaced with other trays without restraint.

Further, in the system cabinet 3, the postprocessing unit 5 is supported so that it can be moved up and down by an elevator mechanism 11.

The elevator mechanism 11 comprises a drive motor 12 made up of a stepping motor, etc., a drive pulley 13 rotated by the drive motor 12, a pair of rotation shafts 14 disposed in parallel with each other in the upper ends of the system cabinet 3, two timing belts 15 placed on the drive pulley 13 and a pair of the rotation shafts 14, four timing belts 16 hung down from both ends of the rotation shafts 14, tension pulleys 17 disposed at the lower ends of the timing belts 16, coil springs 18 for urging the tension pulleys 17 downward, and fasteners 19 for fastening the four timing belts 16 to the four corners of the postprocessing unit 5. The operation of moving up and down the postprocessing unit 5 by the elevator mechanism 11 is guided by the system cabinet 3.

In the described elevator mechanism 11, when the drive pulley 13 is rotated by the drive motor 12, the rotation force is transmitted to a pair of the rotation shafts 14 via the two timing belts 15, whereby the rotation shafts 14 rotate in the same direction, thus the four timing belts 16 placed on the tension pulleys 17 rotate in association with the rotation of the rotation shafts. Then, the four fasteners 19 move up or down at the same distance in accordance with the rotation direction of the timing belts 16, so that the postprocessing unit 5 is moved up or down in the system cabinet 3 accordingly.

Further, a home sensor 20 made of a photo interrupter, for example, is disposed at the bottom of the system cabinet 3. In contrast, a detection piece (not shown) is attached to a lower part of the postprocessing unit 5. When the elevator mechanism 11 is driven for moving down the postprocessing unit 5 to the lowest position (home position), the detection piece attached to the lower part of the postprocessing unit 5 blocks the optical axis of the home sensor 20, thereby switching the home sensor 20 on/off.

Figure 3:
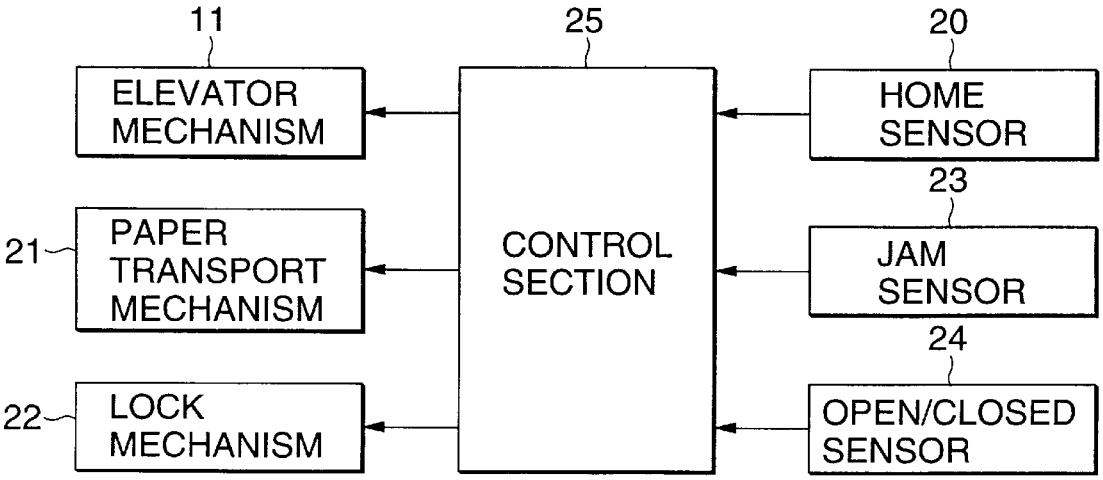
FIG. 3 is a functional block diagram of the postprocessing system in the embodiment.

FIG. 3 is a functional block diagram of the postprocessing system in the embodiment.

In the figure, a paper transport mechanism 21 transports paper sent from the copier main body 1 along a predetermined transport passage.

A lock mechanism 22 locks the cover 7 attached to the front of the system cabinet 3 into a closed state; for example, it locks the cover 7 into a closed state or releases the closed state by operating a plunger using an electromagnetic force, for example.

A jam sensor 23 detects occurrence of a paper jam on the transport passage of paper sent from the copier main body 1 and the occurrence point of the paper jam.

An open/closed sensor 24 detects the open/closed state of the cover 7 attached to the system cabinet 3.

A control section 25 keeps track of the operation state of the postprocessing system 2 based on sensor signals input from the sensors of the home sensor 20, the jam sensor 23, the open/closed sensor 24, etc., and controls the mechanisms of the elevator mechanism 11, the paper transport mechanism 21, the lock mechanism, etc., in response to the operation state.

Next, the operation of the postprocessing system 2 executed based on control instructions from the control section 25 will be discussed with reference to FIG. 4 to FIG. 16.

Figure 4A:
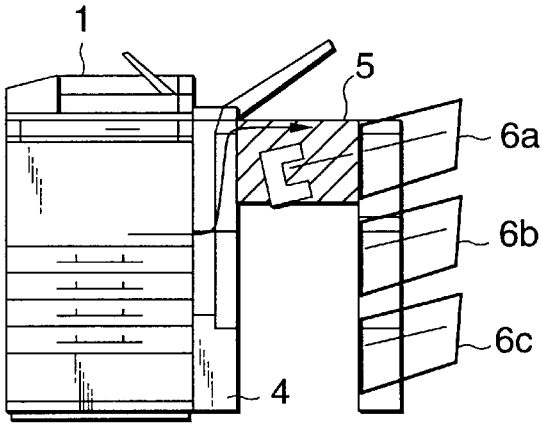
FIGS. 4A and 4B are schematic representations of paper transport patterns (No.1)
Figure 4B:
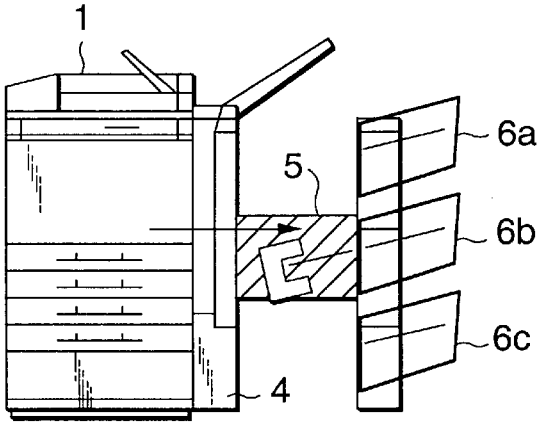
Figure 5A:
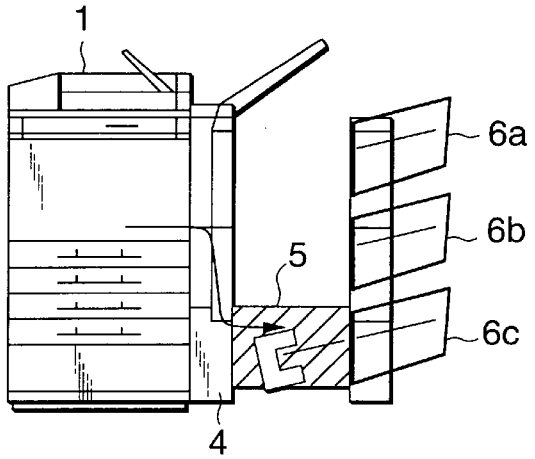
FIGS. 5A to 5F are schematic representations of paper transport patterns (No.2)

First, the following eight patterns exist as paper transport patterns of the paper transport mechanism 21:

In the first pattern, as shown in FIG. 4A, paper sent from the copier main body 1 is fed into the postprocessing unit 5 and further from the postprocessing unit 5 to the upper tray 6*a*. In the second pattern, as shown in FIG. 4B, paper sent from the copier main body is fed from the postprocessing unit 5 to the intermediate tray 6*b*. In the third pattern, as shown in FIG. 5A, paper sent from the copier main body 1 is fed from the postprocessing unit 5 to the lower tray 6*c*.

Figure 5B:
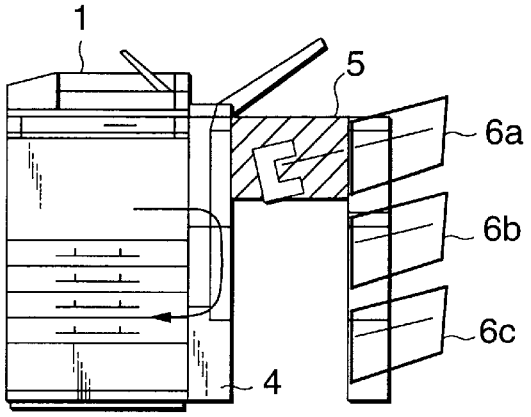
Figure 5C:
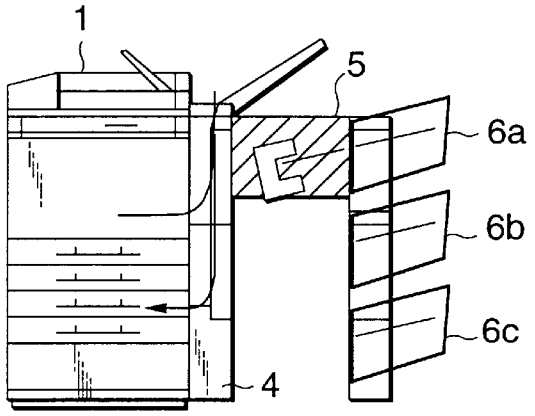
Figure 5D:
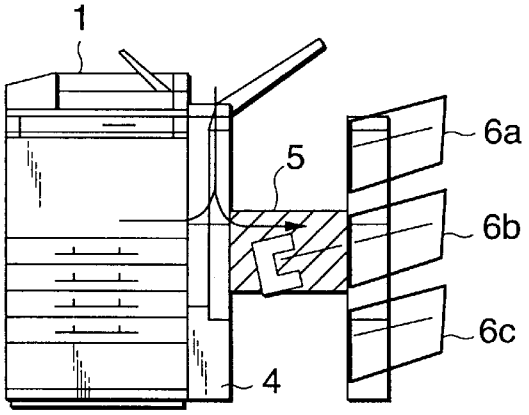
Figure 5E:
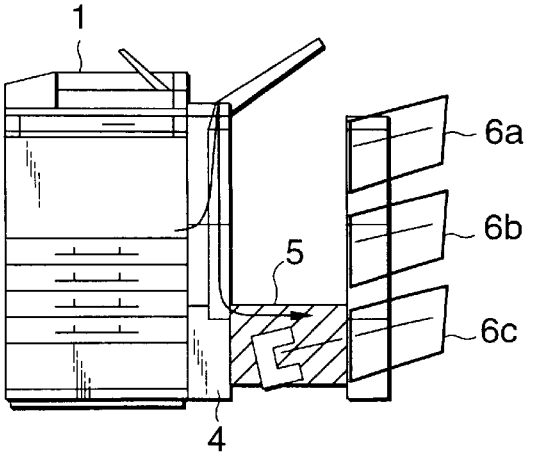
Figure 5F:
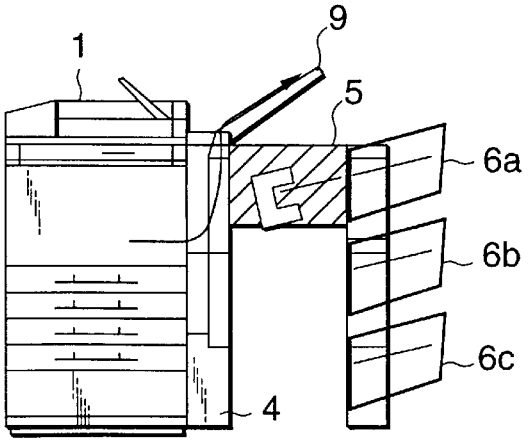

In contrast, in the fourth pattern, as shown in FIG. 5B, paper sent from the copier main body 1 is fed back to a double-sided copy tray (not shown) in the copier main body 1. In the fifth pattern, as shown in FIG. 5C, paper sent from the copier main body 1 is inverted and fed back into the copier main body 1. In the sixth pattern, as shown in FIG. 5D, paper sent from the copier main body 1 is inverted and fed from the postprocessing unit 5 to the intermediate tray 6*b*. In the seventh pattern, as shown in FIG. 5E, paper sent from the copier main body 1 is inverted and fed from the postprocessing unit 5 to the lower tray 6*c*. In the eighth pattern, as shown in FIG. 5F, paper sent from the copier main body 1 is fed to the purge tray 9.

Subsequently, a paper removal (jam clear) procedure executed when a paper jam occurs in the coupling part of the copier main body 1 and the postprocessing system 2 (in the coupling section 4) will be discussed.

Figure 2:
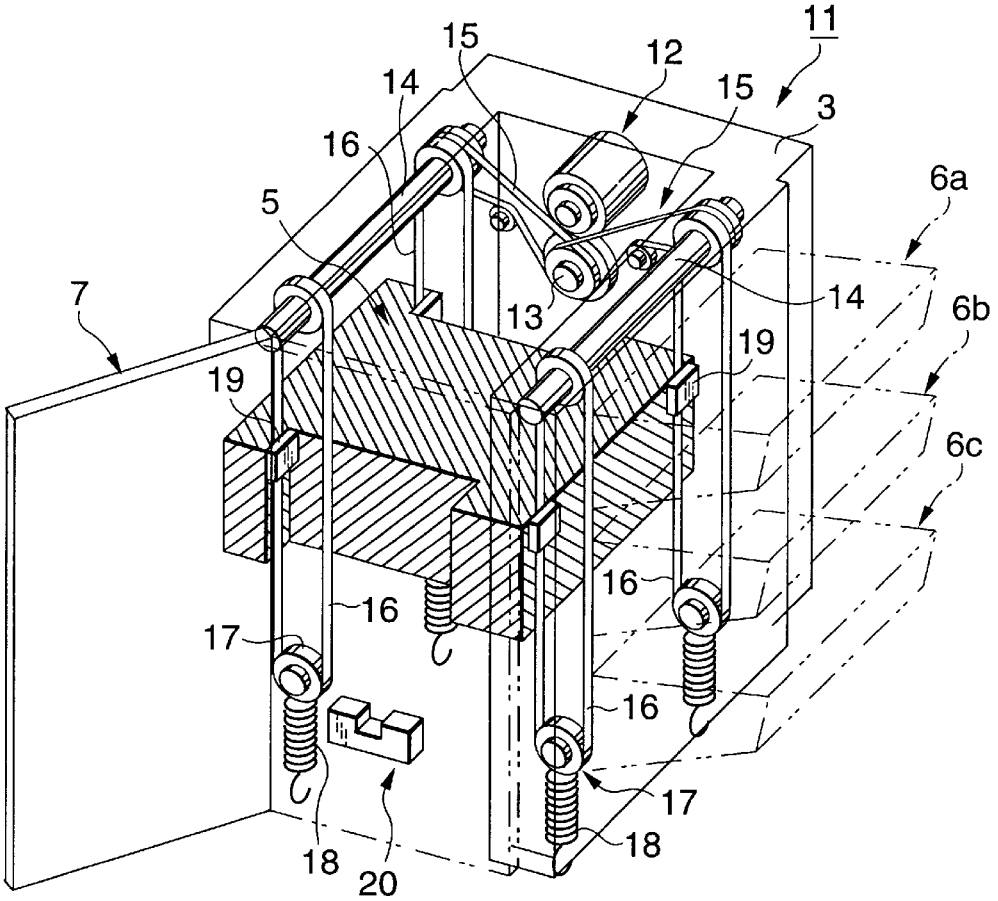
FIG. 2 is a perspective view of a configuration example of an elevator mechanism.
Figure 6A:
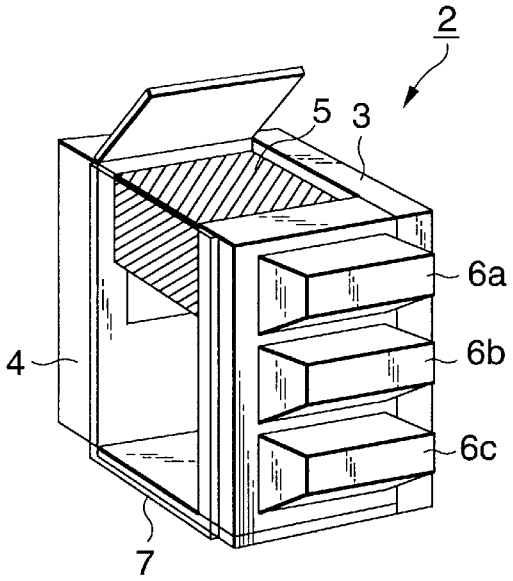
FIGS. 6A to 6D are schematic representations of a paper removal procedure.

First, occurrence of a paper jam in the coupling section 4 is detected by the jam sensor 23. At this time, if the postprocessing unit 5 is at a position other than the home position (lowest position) as shown in FIG. 6A, the elevator mechanism 11 previously described with reference to FIG. 2 and FIG. 3 is driven for causing the postprocessing unit 5 to start moving down. When the home sensor 20 is switched on/off, driving of the elevator mechanism 11 stops, whereby the postprocessing unit 5 stops at the lowest position (home position) as shown in FIG. 6B.

As described above, while the postprocessing unit 5 moves up or down, the cover 7 attached to the front of the system cabinet 3 is locked into a closed state by the lock mechanism 22 (see FIG. 3). When the home sensor 20 is switched on/off, namely, upon completion of the move up or down operation of the postprocessing unit 5, the lock state of the cover 7 by the lock mechanism 22 is released.

Figure 6C:
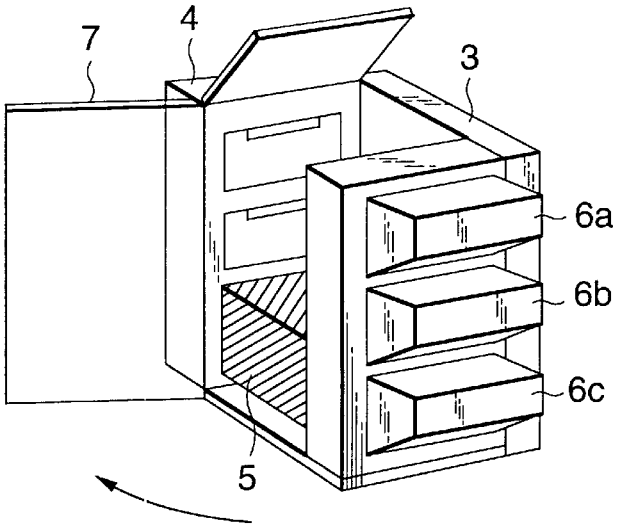
Figure 6B:
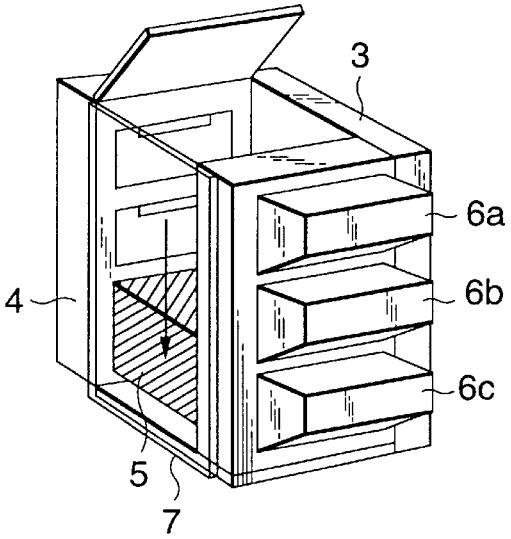

After this, as shown in FIG. 6C, the user opens the cover 7, whereby the inside of the system cabinet 3 is opened. At this time, the open/closed sensor 24 (see FIG. 3) detects the cover 7 being switched from the closed state to the open state.

Figure 6D:
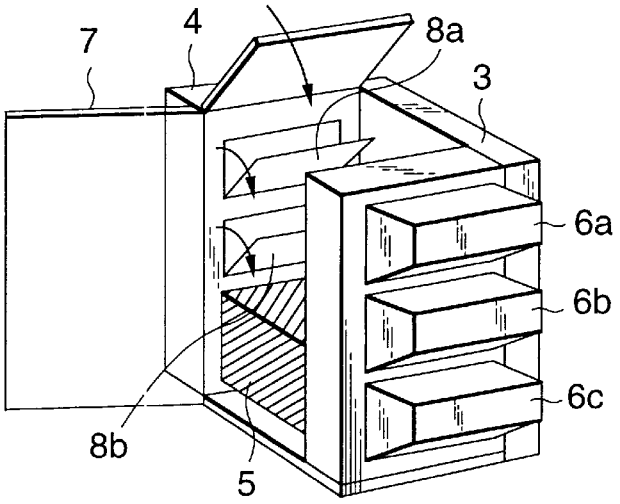

In this state, the postprocessing unit 5 stops at the home position (lowest position). Then, the user can open the paper chute 8*a,* 8*b* in the coupling section 4, as shown in FIG. 6D, for opening the paper transport passage and remove jammed paper therein.

After thus removing the jammed paper, the user closes the paper chute 8*a,* 8*b* for shielding the paper transport passage, then closes the cover 7 and restarts copying (containing postprocessing). At the time, the open/closed sensor 24 checks whether or not the user closes the cover 7 completely. At this time, if the user presses a processing start button although the open/closed sensor 24 does not recognize that the cover 7 is in the closed state, the operation command is once canceled and a message to the effect that the cover 7 is open is displayed on a control panel, etc. When the open/closed sensor 24 recognizes that the cover 7 is in the closed state, the cover 7 is again locked by the lock mechanism 22. In this state, the operation command from the user is accepted and copying is restarted.

Thus, in the embodiment, if a paper jam occurs in the coupling section 4 of the copier main body 1 and the postprocessing system 2, the user can open the cover 7 attached to the system cabinet 3 for opening the inside of the system cabinet 3 and remove jammed paper without moving the postprocessing system 2.

The open/closed sensor 24 detects the open or closed state of the cover 7 and the locked/unlocked state of the cover 7 by the lock mechanism 22 is switched appropriately based on the detection result. Thus, a dangerous situation in which the postprocessing unit 5 moves up or down with the cover 7 open can be avoided, so that the user is assured of safety in performing a sequence of paper removal steps.

Next, paper jam occurrence points and the move up or down operation of the postprocessing unit 5 corresponding to the occurrence points will be discussed.

Figure 7:
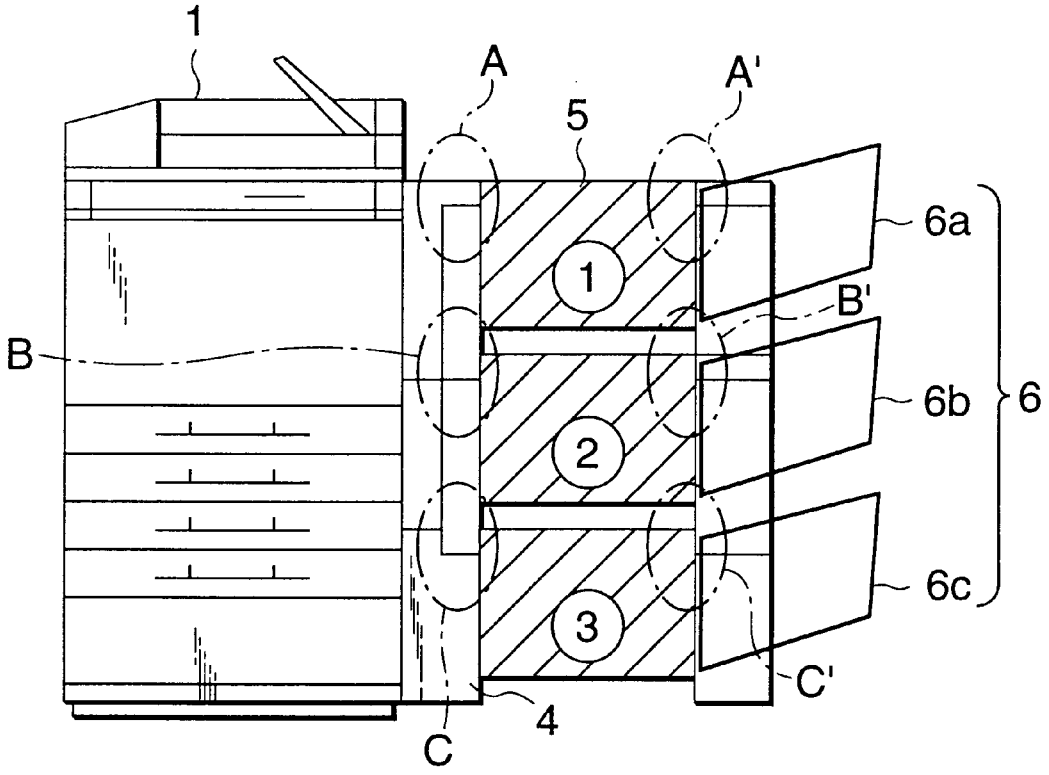
FIG. 7 is a schematic representation of the basic stop positions of a postprocessing unit.
Figure 8:
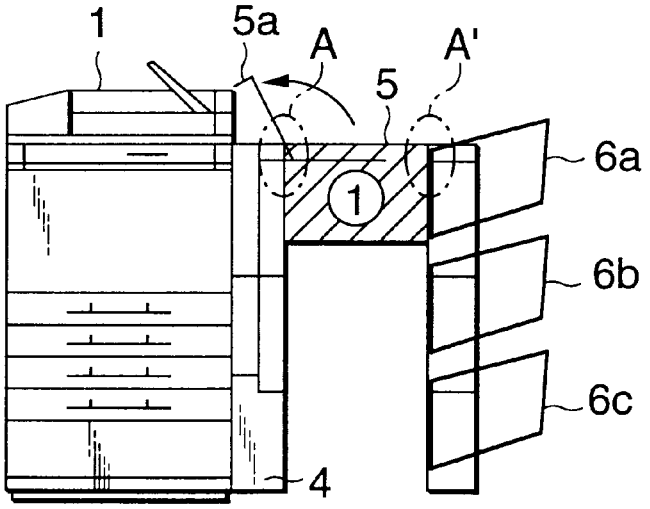
FIG. 8 is a schematic representation of the move up or down operation of the postprocessing unit corresponding to paper jam occurrence positions (No.1)

First, as shown in FIG. 7, if a paper jam occurs in a state in which the postprocessing unit 5 stops at position (1) corresponding to the upper tray 6*a* and paper causing the paper jam exists in part A spreading across the coupling section 4 and the postprocessing unit 5 or part A' spreading across the postprocessing unit 5 and the tray unit 6, the postprocessing unit 5 is held in a stop state at the position (1) as shown in FIG. 8 so that the jammed paper is not torn as the postprocessing unit 5 moves up or down. Then, the user can open the paper chute 5*a* in the postprocessing unit 5 and remove the jammed paper in the part A or A'.

Figure 9A:
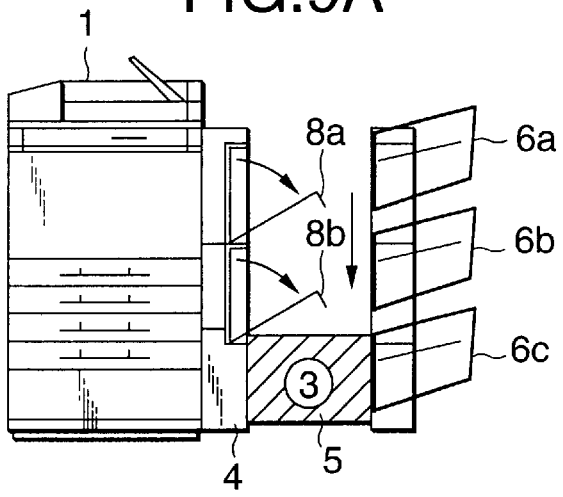
FIGS. 9A to 9C are schematic representations of the move up or down operation of the postprocessing unit corresponding to paper jam occurrence positions (No.2)
Figure 9B:
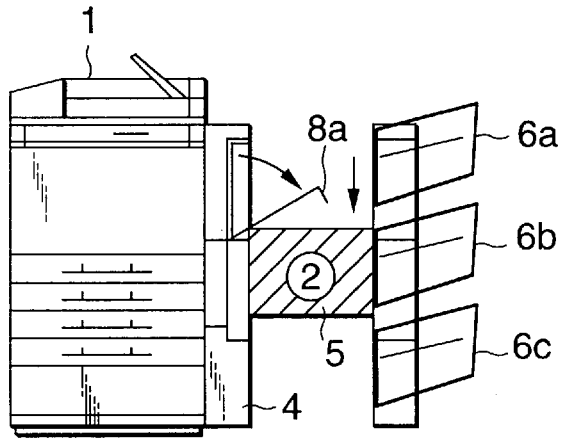
Figure 9C:
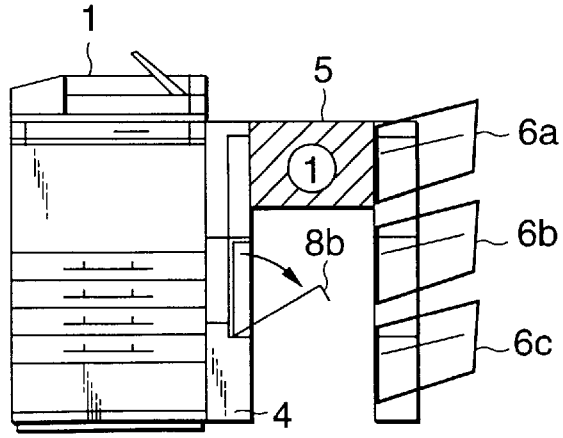

In contrast, if the jammed paper exists in the coupling section 4 instead of the part A or A', the postprocessing unit 5 is moved down to position (3) as shown in FIG. 9A, whereby the user can open the paper chute 8*a,* 8*b* in the coupling section 4 and remove the jammed paper therein. If the postprocessing unit 5 is moved down to the position (2) as shown in FIG. 9B, the user can open the paper chute 8*a* in the upper part of the coupling section 4 and remove the jammed paper therein. Further, if the postprocessing unit 5 is held in a stop state at the position (1) as shown in FIG. 9C, the user can open the paper chute 8*b* in the lower part of the coupling section 4 and remove the jammed paper therein.

Figure 10A:
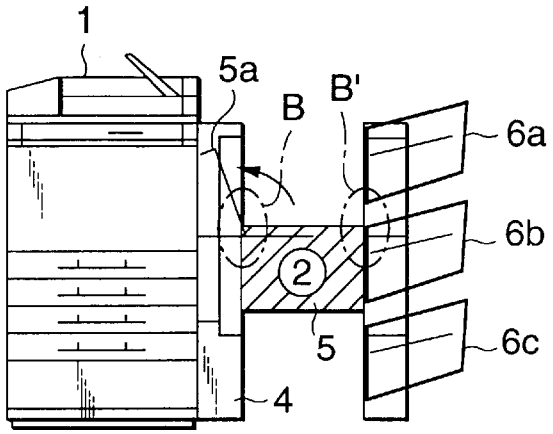
FIGS. 10A to 10C are schematic representations of the move up or down operation of the postprocessing unit corresponding to paper jam occurrence positions (No.3)

On the other hand, as shown in FIG. 7, if a paper jam occurs in a state in which the postprocessing unit 5 stops at position (2) corresponding to the intermediate tray 6*b* and paper causing the paper jam exists in part B spreading across the coupling section 4 and the postprocessing unit 5 or part B' spreading across the postprocessing unit 5 and the tray unit 6, the postprocessing unit 5 is held in a stop state at the position (2) as shown in FIG. 10A so that the jammed paper is not torn as the postprocessing unit 5 moves up or down. Then, the user can open the paper chute 5*a* in the postprocessing unit 5 and remove the jammed paper in the part B or B'.

Figure 10B:
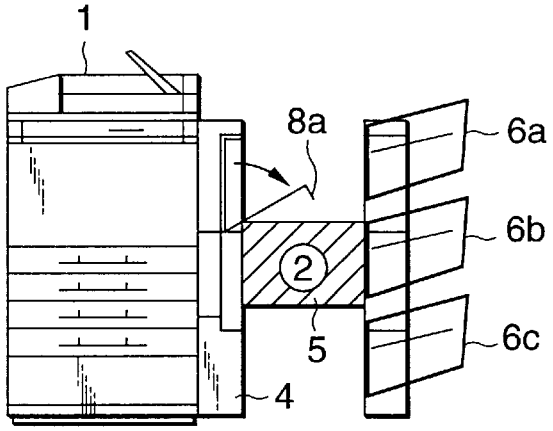
Figure 10C:
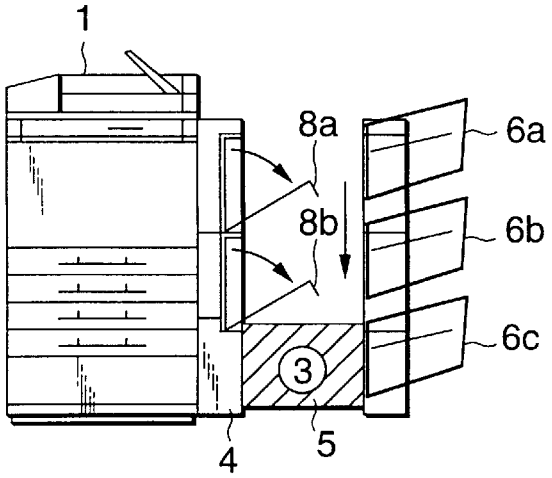

In contrast, if the jammed paper exists in the coupling section 4 instead of the part B or B', the postprocessing unit 5 is held in the stop state at the position (2) as shown in FIG. 10B, whereby the user can open the paper chute 8*a* in the upper part of the coupling section 4 and remove the jammed paper therein. If the postprocessing unit 5 is moved down to the position (3) as shown in FIG. 10C, the user can open the paper chute 8*a,* 8*b* in the coupling section 4 and remove the jammed paper therein.

Figure 11A:
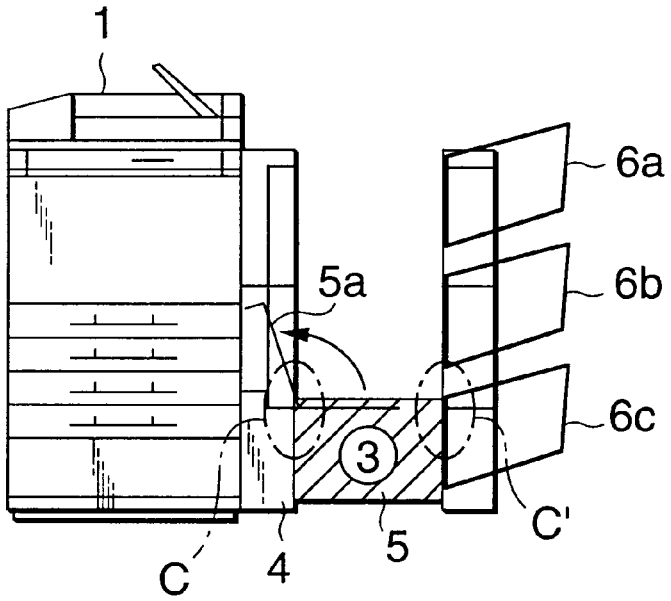
FIGS. 11A and 11B are schematic representations of the move up or down operation of the postprocessing unit corresponding to paper jam occurrence positions (No.4)

In addition, as shown in FIG. 7, if a paper jam occurs in a state in which the postprocessing unit 5 stops at position (3) corresponding to the lower tray 6*c* and paper causing the paper jam exists in part C spreading across the coupling section 4 and the postprocessing unit 5 or part C' spreading across the postprocessing unit 5 and the tray unit 6, the postprocessing unit 5 is held in a stop state at the position (3) as shown in FIG. 11A so that the jammed paper is not torn as the postprocessing unit 5 moves up or down. Then, the user can open the paper chute 5*a* in the postprocessing unit 5 and remove the jammed paper in the part C or C'.

Figure 11B:
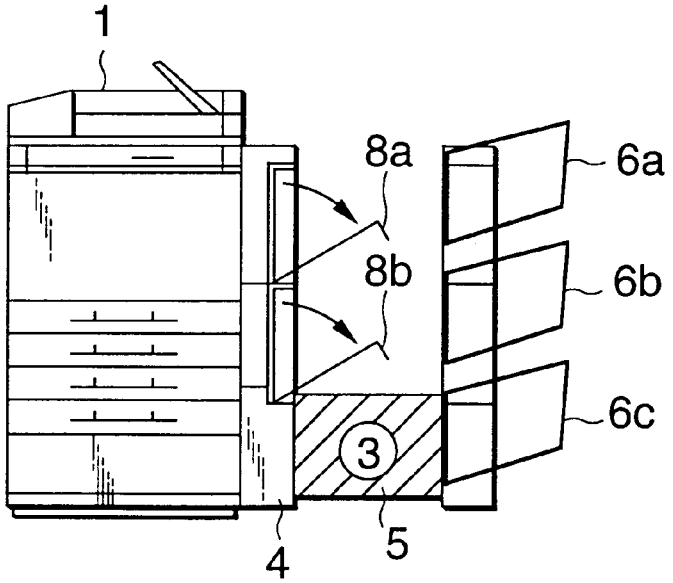

Further, if the jammed paper exists in the coupling section 4 instead of the part C or C', the postprocessing unit 5 is held in the stop state at the position (3) as shown in FIG. 11B, whereby the user can open the paper chute 8*a,* 8*b* in the coupling section 4 and remove the jammed paper therein.

If a paper jam occurs in the coupling section 4 as described above, in any situation, the postprocessing unit 5 is stopped at the position (3) (home position), whereby the user can open the paper chute 8*a,* 8*b* appropriately and remove the jammed paper. If the postprocessing unit 5 is stopped at the position (3) (lowest position), when the user visually checks the paper jam condition or remove jammed paper, the postprocessing unit 5 does not becomes an obstacle, the user can execute paper removal work comparatively easily.

However, when the postprocessing unit 5 stops at the position (1), if a paper jam occurs in the coupling section 4 and moreover the user can remove jammed paper simply by opening either paper chute 8*a* or 8b, considering the wait time until the lock state of the cover 7 is released after the paper jam occurs, the wait time can be shortened by moving down the postprocessing unit 5 and stopping it at the position (2) or holding the postprocessing unit 5 in a stop state at the position (1).

Here, the position (3) is set to the home position of the postprocessing unit 5. In addition, for example, the highest position not interfering with the paper chute 8*a* or 8*b* in the coupling section 4 (position above the position (1)) may be set as the home position of the postprocessing unit 5.

Subsequently, a paper removal procedure executed when a paper jam occurs during paper collating in the postprocessing unit 5 will be discussed.

Figure 12A:
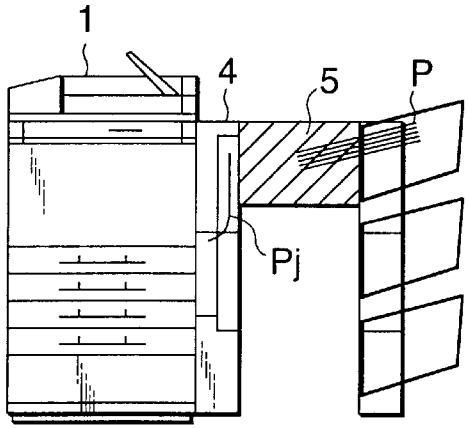
FIGS. 12A to 12F are schematic representations of a paper removal procedure executed when a paper jam occurs during paper collating (No.1)
Figure 12B:
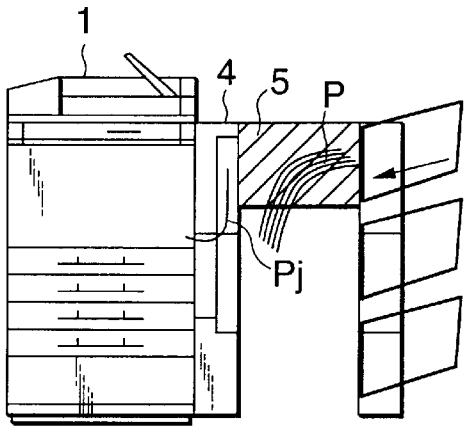

First, as shown in FIG. 12A, when a predetermined number of sheets of paper P have been collated in the postprocessing unit 5, if the next fed paper sheet Pj is jammed in the coupling section 4, the paper sheets P collated so far are brought completely into in the postprocessing unit 5 as shown in FIG. 12B.

Figure 12C:
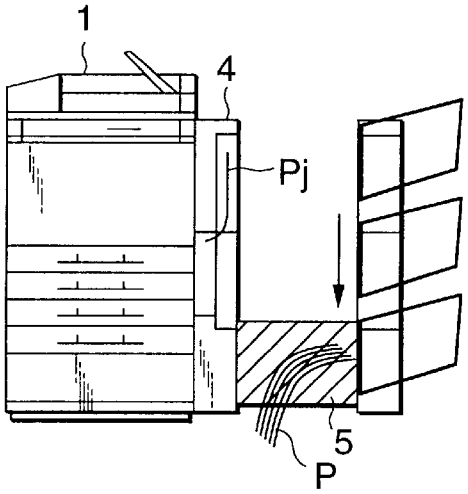
Figure 12D:
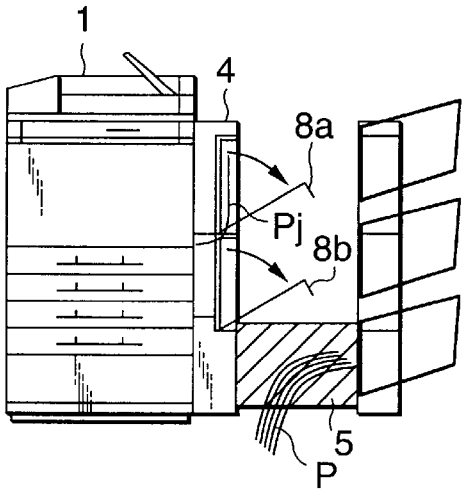

Next, as shown in FIG. 12C, the postprocessing unit 5 is moved down to a predetermined position (in this case, the lowest position) in response to the paper jam occurrence point (jammed paper Pj position). When the postprocessing unit 5 arrives at the target position, the lock state of the cover 7 by the lock mechanism 22 is released, whereby the user opens the cover 7 for opening the inside of the system cabinet 3 as previously shown in FIG. 6C and in this state, can open the paper chute 8*a,* 8*b* in the coupling section 4 as shown in FIG. 12D and remove the paper Pj jammed therein.

Figure 12E:
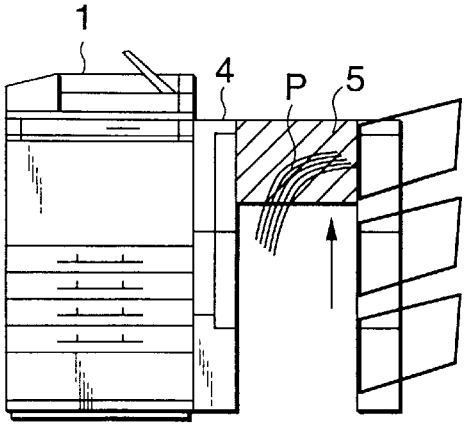
Figure 12F:
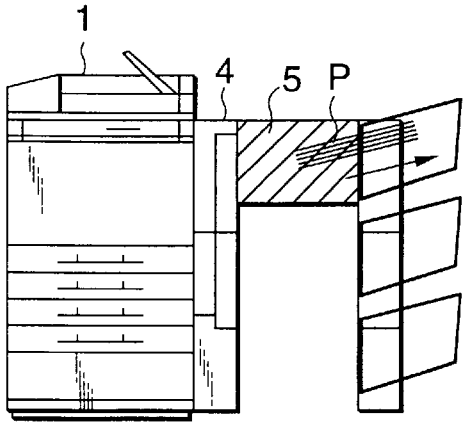

After this, if the open/closed sensor 24 recognizes that the cover 7 has been closed by the user, the cover 7 is again locked into the closed state by the lock mechanism 22. In this state, the postprocessing unit 5 is moved up to the former position as shown in FIG. 12E and feeds the paper sheets P previously brought into the postprocessing unit 5 to the tray as shown in FIG. 12F, whereby the system is recovered to the state before occurrence of the paper jam and processing is restarted.

Figure 13A:
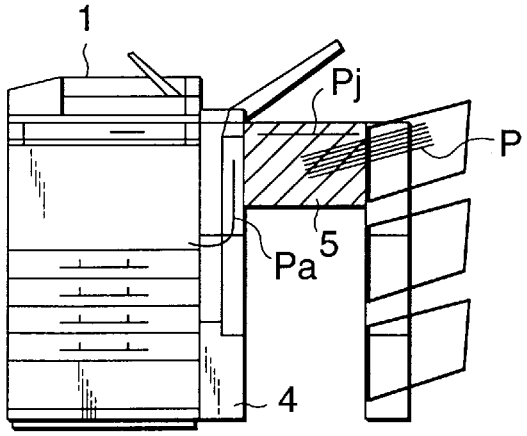
FIGS. 13A to 13C are schematic representations of a paper removal procedure executed when a paper jam occurs during paper collating (No.2)
Figure 13B:
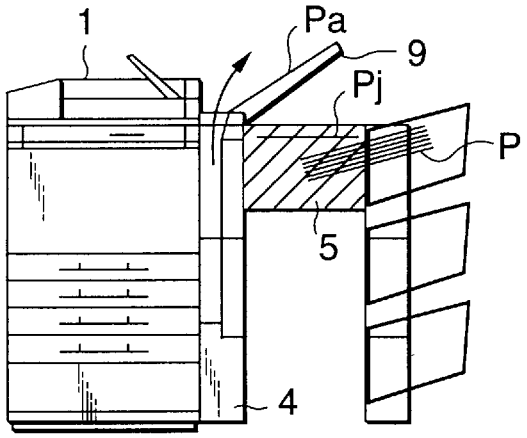
Figure 13C:
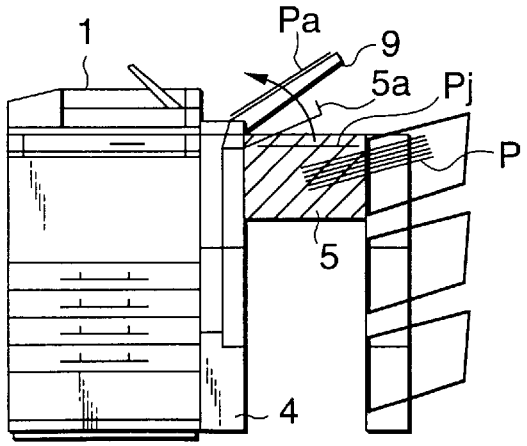

In contrast, as shown in FIG. 13A, when a predetermined number of sheets of paper P have been collated in the postprocessing unit 5, if the next fed paper sheet Pj is jammed in the postprocessing unit 5 and causes the subsequent paper sheet Pa to stop in the coupling section 4, the user uses the paper transport function in the coupling section 4 to discharge the paper sheet Pa to the purge tray 9 as shown in FIG. 13B and in this state, opens the paper chute 5*a* in the postprocessing unit 5 as shown in FIG. 13C and removes the paper Pj jammed therein.

Figure 14A:
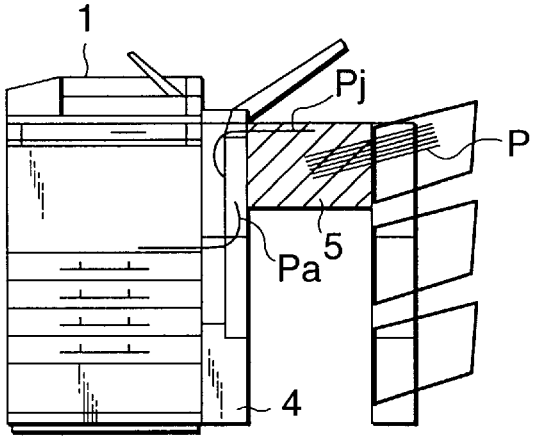
FIGS. 14A to 14C are schematic representations of a paper removal procedure executed when a paper jam occurs during paper collating (No.3)
Figure 14B:
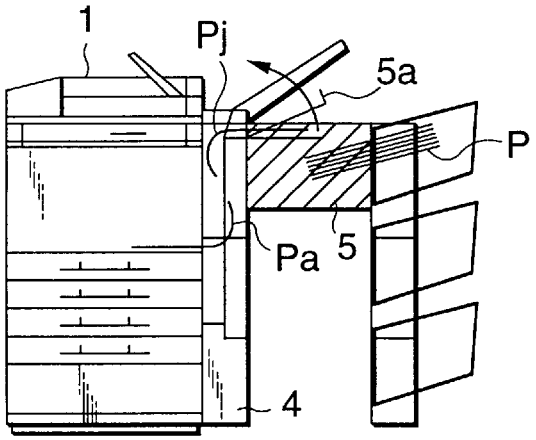
Figure 14C:
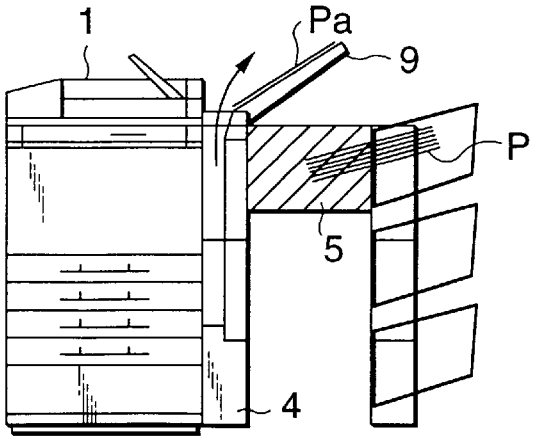

On the other hand, as shown in FIG. 14A, when a predetermined number of sheets of paper P have been collated in the postprocessing unit 5, if the next fed paper sheet Pj is jammed spreading across the coupling section 4 and the postprocessing unit 5 and causes the subsequent paper sheet Pa to stop spreading across the copier main body 1 and the coupling section 4, the user opens the paper chute 5*a* in the postprocessing unit 5 as shown in FIG. 14B and removes the paper Pj jammed therein and in this state, uses the paper transport function in the coupling section 4 to discharge the paper sheet Pa to the purge tray 9.

By the way, to remove paper jammed in the coupling section 4, the user opens the cover 7, then opens the paper chute 8*a,* 8*b* in the coupling section 4 and removes the jammed paper. If the following configuration is adopted, user's trouble in the paper removal work can be saved:

First, three basic positions corresponding to the trays 6*a,* 6*b,* and 6*c* (positions (1), (2), and (3) shown in FIG. 7) are set as the stop positions of the postprocessing unit 5. Then, in addition to these three basic positions, for example, as shown in FIG. 15A, the fourth position (position (4)) is set below the position corresponding to the lower tray 6*c* (position (3) in FIG. 7) or as shown in FIG. 15B, is set above the position corresponding to the upper tray 6*a* (position (1) in FIG. 7).

On the other hand, the paper chutes 5*a,* 8*a,* and 8*b* in the postprocessing unit 5 and the coupling section 4 are designed to be able to be opened and closed by a cam mechanism (not shown), for example, and the operation opening or closing the paper chutes 5*a,* 8*a,* and 8*b* by the cam mechanism is associated with the operation moving up or down the postprocessing unit 5. If a paper jam occurs in the coupling section 4, the postprocessing unit 5 is always moved to the fourth position and all the paper chutes 5*a,* 8*a,* and 8*b* are opened in association with the postprocessing unit 5 moved to the fourth position.

Figure 15A:
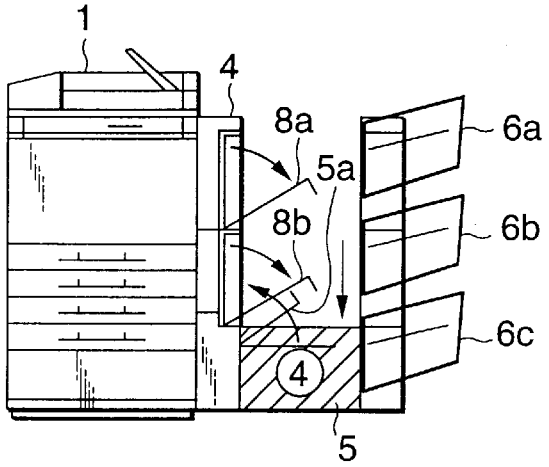
FIGS. 15A to 15C are schematic representations of a first application example of the postprocessing system according to the invention.
Figure 15B:
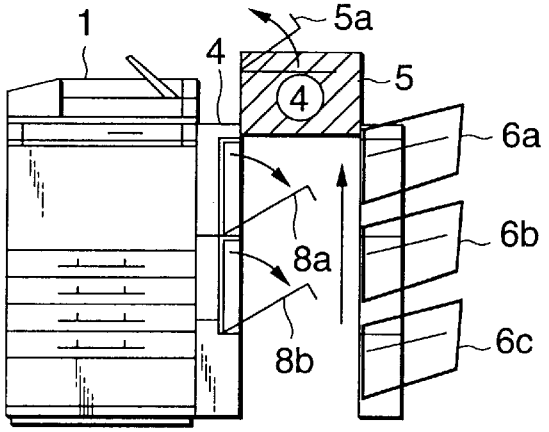
Figure 15C:
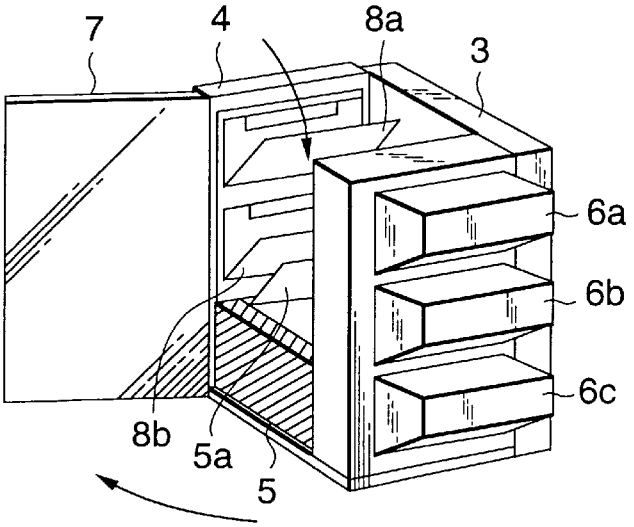

Thus, when the user opens the cover 7 when the postprocessing unit 5 is moved to and stops at the fourth position, all the paper chutes 5*a,* 8*a,* and 8*b* are already open, namely, the transport passages in the paper transport mechanism 21 become open, as shown in FIG. 15C. Thus, the user can remove jammed paper without the need for opening the paper chute 5*a,* 8*a,* 8*b*. When the postprocessing unit 5 is moved from the fourth position to the former position (position (1), (2), or (3) shown in FIG. 7) after jammed paper is removed, all the paper chutes 5*a,* 8*a,* and 8*b* are also closed in association with the postprocessing unit 5 moved to the former position, thus also eliminating the need for the user to close the paper chute 5*a,* 8*a,* 8*b*.

In this connection, a total of five positions of the three basic positions corresponding to the trays plus both the fourth position (highest position) shown in FIG. 15A and the fourth position (lowest position) shown in FIG. 15B can also be set as the stop positions of the postprocessing unit 5. In doing so, when a paper jam occurs, the stop position of the postprocessing unit 5 is compared with each of the fourth positions set at the upper and lower ends and the postprocessing unit 5 is moved to the fourth position closer to the stop position of the postprocessing unit 5, whereby the unit move time can be shortened.

Figure 16A:
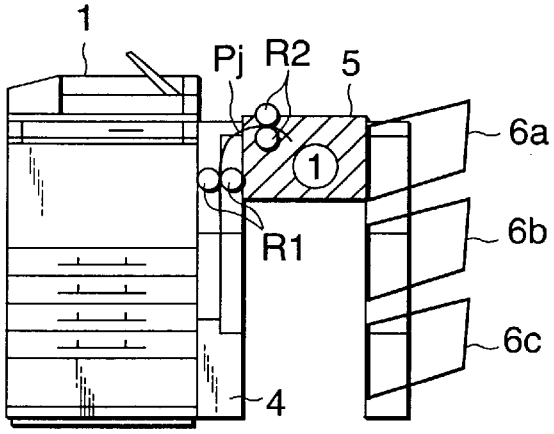
FIGS. 16A to 16C are schematic representations of a second application example of the postprocessing system according to the invention.
Figure 16B:
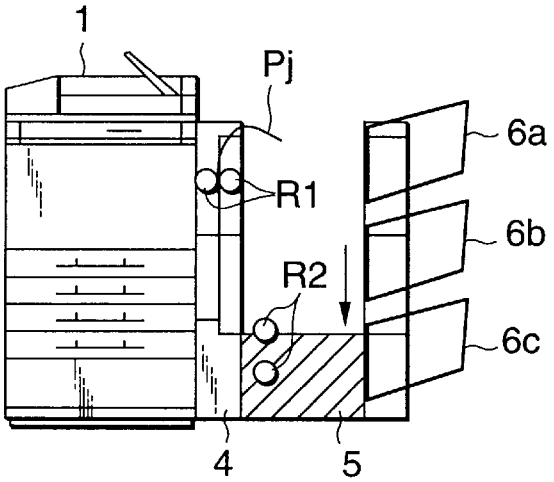
Figure 16C:
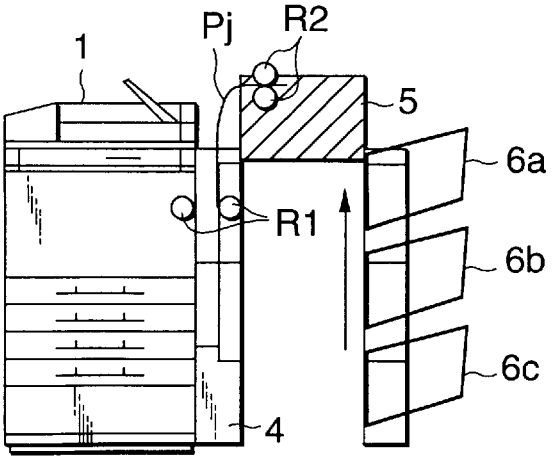

FIGS. 16A to 16C are schematic representations of a preferred operation example applied when paper sent out from the copier main body 1 is jammed spreading across the coupling section 4 and the postprocessing unit 5.

First, assume as a paper jam occurrence situation that jammed paper Pj exists spreading across the coupling section 4 and the postprocessing unit 5 with the postprocessing unit 5 stopping at the position (1) corresponding to the upper tray 6*a,* for example, as shown in FIG. 16A. At this time, assume that in the coupling section 4, a transport roll pair R1 clamps the trailing end of the jammed paper Pj and that in the postprocessing unit 5, another transport roll paper R2 clamps the leading end of the jammed paper Pj.

In such a case, as shown in FIG. 16B, the clamp state of the transport roll paper R2 in the postprocessing unit 5 is released with the trailing end of the jammed paper Pj clamped by the transport roll pair R1 in the coupling section 4 and in this state, the postprocessing unit 5 is moved down, whereby the leading end of the jammed paper Pj sticks out of the coupling section 4. Thus, the user can pick up the sticking-out portion with his or her fingers and remove the jammed paper Pj easily.

As shown in FIG. 16C, if the clamp state of the transport roll paper R1 in the coupling section 4 is released with the leading end of the jammed paper Pj clamped by the transport roll pair R2 in the postprocessing unit 5 and in this state, the postprocessing unit 5 is moved up, the trailing end of the jammed paper Pj sticks out of the postprocessing unit 5. Thus, the user can remove the jammed paper Pj easily in a similar manner to that described above.

Figure 17A:
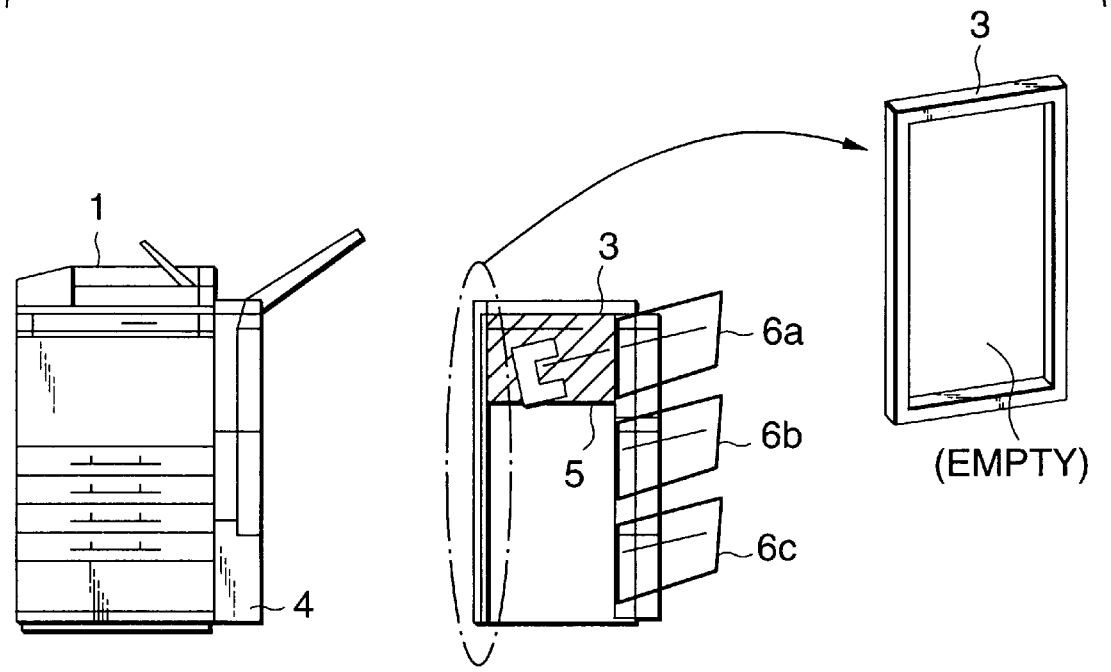
FIGS. 17A and 17B are schematic representations of a modified embodiment of the postprocessing system according to the invention.
Figure 17B:
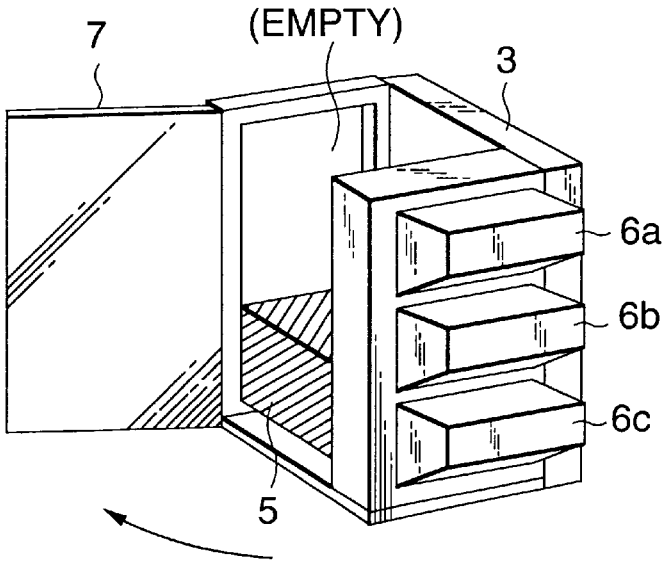

In the embodiment, the coupling section 4 is installed in the postprocessing system 2, but may be placed in either the copier main body 1 or the postprocessing system 2. In this connection, to place the coupling section 4 in the copier main body 1, as shown in FIG. 17A, the side wall portion of the system cabinet 3 connected to the coupling section 4 becomes open and empty. When the user opens the cover 7, as shown in FIG. 17B, as a paper jam occurs, he or she removes paper jammed in the coupling section 4 through the empty portion.

As described above, according to the invention, if a paper jam occurs in the coupling section of the image formation system main body and the postprocessing system, the user can open the cover attached to the front of the system cabinet for opening the inside thereof and remove jammed paper without moving the postprocessing system. Thus, for system installation, it becomes unnecessary to reserve an extra space to allow the postprocessing system to be moved to remove jammed paper, so that the system installation space can be reduced.

What is claimed is:

1. A postprocessing system of an image formation system, comprising:

a system cabinet coupled to an image formation system main body;

a postprocessing unit placed in said system cabinet;

a cover being attached at least to a front of said system cabinet so as to be opened and closed for opening an inside of said system cabinet in an open state; and a lock mechanism for locking said cover, wherein the postprocessing system unlocks the lock mechanism if a paper jam occurs.

2. A postprocessing system of an image formation system comprising:

a system cabinet coupled to an image formation system main body;

a postprocessing unit placed in said system cabinet;

a cover being attached at least to a front of said system cabinet so as to be opened and closed for opening the inside of said system cabinet in an open state;

an elevator mechanism for moving up and down said postprocessing unit;

detection means for detecting occurrence of a paper jam on a transport passage of paper sent out from said image formation system main body and an occurrence point of the paper jam; and control means for driving and controlling said elevator mechanism to move said postprocessing unit to a predetermined position in response to the occurrence point of the paper jam detected by said detection means.

3. The postprocessing system of claim 2, wherein if a paper jam is detected by said detection means, said control means unlocks said lock mechanism with said postprocessing unit moving to and stopping at the predetermined position.

4. The postprocessing system of claim 2, further comprising:

a paper transport mechanism for transporting paper sent out from said image formation system main body along a predetermined transport passage, wherein if occurrence of a paper jam is detected by said detection means, the predetermined transport passage in said paper transport mechanism is opened in association with operation moving up or down said postprocessing unit by said elevator mechanism.

5. The postprocessing system of claim 2, wherein if paper is jammed spreading across a coupling section for coupling said system cabinet to said image formation system main body and said postprocessing unit, said control means drives said elevator mechanism for moving said postprocessing unit to the predetermined position in a state in which a clamp state of either of a transport roll pair in said coupling section for clamping one end of the paper and a transport roll pair in said postprocessing unit for clamping an opposite end of the paper is released.

6. A postprocessing system of an image formation system for performing postprocessing for paper on which an image is formed by said image formation system comprising:

a postprocessing unit having postprocessing means for applying postprocessing to paper on which an image is formed by said image formation system;

a plurality of trays for stacking the paper to which postprocessing is applied by said postprocessing means;

move means for moving said postprocessing unit so as to correspond to any of said plurality of trays;

detection means for detecting occurrence of a paper jam of the paper on which the image is formed by said image formation system and a position of the paper jam; and control means for controlling said move means so as to move said postprocessing unit to a predetermined position based on the detection result of said detection means.

7. The postprocessing system of claim 6, wherein said image formation system or said postprocessing system has at least one open/close section being disposed along a paper transport passage to remove jammed paper, and wherein the predetermined position defined by said control means is a position not interfering with opening/closing of said open/close section.

8. The postprocessing system of claim 6, wherein said image formation system or said postprocessing system has a plurality of open/close sections being disposed along a paper transport passage to remove jammed paper, and wherein the predetermined position defined by said control means is a position not interfering with opening/closing of one of said plurality of open/close sections, required for handling a paper jam.

9. A postprocessing system of an image formation system for performing postprocessing for paper on which an image is formed by said image formation system comprising:

a postprocessing unit having postprocessing means for applying postprocessing to paper on which an image is formed by said image formation system;

a plurality of trays for stacking the paper to which postprocessing is applied by said postprocessing means;

move means for moving said postprocessing unit so as to correspond to any of said plurality of trays;

detection means for detecting occurrence of a paper jam of the paper on which the image is formed by said image formation system and a position of the paper jam;

selection means, when occurrence of the paper jam is detected by said detection means, for selecting holding said postprocessing unit at the position thereof when the paper jam occurs or moving said postprocessing unit to a predetermined position; and control means, if moving said postprocessing unit to the predetermined position is selected by said selection means, for controlling said move means so as to move said postprocessing unit to the predetermined position.

10. The postprocessing system of claim 9, wherein if said detection means detects a part of paper existing on a paper transport passage in said postprocessing unit, said selection means selects holding said postprocessing unit without moving the postprocessing unit, and wherein if said detection means detects no paper existing on the paper transport passage in said postprocessing unit, said selection means selects moving said postprocessing unit to the predetermined position by said move means.

11. The postprocessing system of claim 9, wherein said image formation system or said postprocessing system has at least one open/close section being disposed along a paper transport passage to remove jammed paper, and wherein the predetermined position defined by said control means is a position not interfering with opening/closing of said open/close section.

12. The postprocessing system of claim 9, wherein said image formation system or said postprocessing system has a plurality of open/close sections being disposed along a paper transport passage to remove jammed paper, and wherein the predetermined position defined by said control means is a position not interfering with opening/closing of one of said plurality of open/close sections, required for handling the paper jam.

13. A method of postprocessing a paper from an image formation system, comprising:

performing postprocessing on the paper;

detecting if a paper jam condition of the paper occurs during said postprocessing; and if a paper jam condition is detected, either holding a vertically movable postprocessing unit in a current position or moving the vertically movable postprocessing unit to a predetermined position.

14. The method of claim 13, wherein if a part of the paper is detected on a transport passage of the vertically movable postprocessing unit, the vertically movable postprocessing unit is held in a current position.

15. The method of claim 13, further comprising:

locking a cover of the vertically movable postprocessing unit while postprocessing is being performed.

16. The method of claim 15, wherein the cover is unlocked when a paper jam condition is detected.

* * * * *